US006948979B2

(12) United States Patent
Chien et al.

(10) Patent No.: US 6,948,979 B2
(45) Date of Patent: Sep. 27, 2005

(54) ELECTRICAL CONNECTOR ASSEMBLY

(75) Inventors: Chih-Ming Chien, Tu-Chen (TW); Yi-Wen Wang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/867,596

(22) Filed: Jun. 14, 2004

(65) Prior Publication Data

US 2004/0266263 A1 Dec. 30, 2004

(30) Foreign Application Priority Data

Jun. 13, 2003 (TW) ..... 92210870 U

(51) Int. Cl.[7] ..... H01R 13/648
(52) U.S. Cl. ..... 439/607; 439/79
(58) Field of Search ..... 439/79, 80, 607, 439/608

(56) References Cited

U.S. PATENT DOCUMENTS 3,722,923 A * 3/1973 Grahl ..... 285/55
3,999,827 A * 12/1976 Hutchison et al. ..... 439/71
4,173,387 A * 11/1979 Zell ..... 439/557
4,188,085 A * 2/1980 Aldridge et al. ..... 439/525
4,736,266 A * 4/1988 Tanibe ..... 361/816
4,874,336 A * 10/1989 Marsh ..... 439/607
5,702,258 A * 12/1997 Provencher et al. ..... 439/79
5,743,751 A * 4/1998 Davis et al. ..... 439/79
6,137,689 A * 10/2000 Schechtel et al. ..... 361/759
6,155,876 A * 12/2000 Ho et al. ..... 439/607
6,457,986 B2 * 10/2002 Hirata ..... 439/342
2004/0097134 A1 * 5/2004 Zaderej et al. ..... 439/607

* cited by examiner

*Primary Examiner*—Renee Luebke
*Assistant Examiner*—James R. Harvey
(74) *Attorney, Agent, or Firm*—Wei Te Chung

(57) ABSTRACT

An electrical connector assembly (10) includes at least one connector (12) and a shell (14) surrounding the connector. A number of locking tabs (24) extend vertically beyond a joint face (23) of the connector. Each locking tab defines an aperture (242) and a block (243) at a free end thereof. The aperture separates the free end of the locking tab into two spaced portions. The block protrudes outwardly from an outside of one of the two spaced portions. An opening (232) under the block is defined in the joint face for facilitating the molding of the block. The shell defines a number of securing holes (411) engagingly receiving the corresponding locking tabs of the connector. The block can press an outside of the shell to retain the locking tab in the hole. Reliable connection between the connector and the shell is secured.

20 Claims, 7 Drawing Sheets

ELECTRICAL CONNECTOR ASSEMBLY

BACKGROUND OF THE INVENTION

1. Field of the Invention

The present invention relates to the art of electrical connectors, and more particularly to an electrical connector assembly for electrically connecting an electrical interface such as a small form factor pluggable (SFP) optical transceiver, to a circuit substrate such as a printed circuit board (PCB).

2. Description of the Prior Art

An electrical assembly used for electrical engagement between a SFP optical transceivers and a PCB is widely applied in the field of electronics. (SFP is a kind of agreement of new type optical transceiver). An example of such an electrical assembly is disclosed in FIG. 7. The connector assembly 60 includes a connector 62 and a metal shell 66 surrounding the connector 62. A receiving groove 64 is defined in a front face (not numbered) of the connector 62, for receiving a transceiver. The shell 66 can provide Electro Magnetic Interference (EMI) shielding for the connector 62. However, this connector assembly 60 has a shortcoming that there is no fastening means between the connector 62 and the shell 66. When the connector 62 and the shell 66 are assembled together, this thereby can effect reliable engagement between the connector 62 and the shell 6.

FIG. 8 shows another conventional connector assembly 70. The connector assembly 70 comprises a rectangular shell 80 and a plurality of sub-connectors 72 surrounded in the shell 80. Each sub-connector 72 defines two parallel grooves 74 in a front face thereof. However there is also no fastening means between the sub-connector 72 and the shell 80, when the sub-connector 72 is assembled in the shell 80, stability of engagement between the sub-connector 72 and the shell 80 is decreased. Further, when the assembly 70 is mounted to a PCB, terminals 76 and posts 78 of the sub-connector 72 each are inserted into corresponding hole defined in the PCB. During the insertion, each terminal 76 and post 78 overcome an intervene of the terminal 76 and the post 78 with the PCB. Because there is a plurality of sub-connectors 72, thus larger intervene force is generated during the mounting, compared with assembling only one connector to the PCB. The large intervene force is prone to result in damaging the terminals, the posts, or the PCB, or all. This can also affect reliable engagement between the sub-connector 72 and the shell 80.

Therefore, a new electrical connector assembly which overcomes the above-mentioned disadvantages of the prior art is desired.

SUMMARY OF THE INVENTION

Accordingly, one object of the present invention is to provide a new electrical connector assembly able to assure reliable engagement between a shell and connectors thereof.

To achieve the aforementioned object, an electrical connector assembly in accordance with a preferred embodiment of the present invention is provided for electrically connecting to a PCB. The connector assembly comprises at least one connector and a shell surrounding said connector. Said connector has a horizontal joint face opposite to the PCB. A plurality of locking tabs extends longitudinally beyond the joint face. An aperture is defined in a free end of each locking tab, for allowing resilient deformation of the locking tab. A first guiding slope is formed at the free end of the locking tab. A block protrudes outwardly from an outside of the free end of the locking tab, having a second guiding slope at a free end thereof. A plurality of securing holes is defined in the shell, for engagingly receiving corresponding locking tabs of said connector. When said connector is assembled in the shell, the locking tabs are inserted into the corresponding securing holes with the guidance of the first and second guiding slopes. During the insertion, the locking tabs resiliently deform inwardly to allow the locking tabs to retain in the corresponding securing holes, said connector thereby assembled into the shell firmly. Furthermore, when said connector is assembled in the shell, the block of the locking tab abuts and presses against an outside of the shell. Thereby, the shell covers on the joint face of said connector firmly. Thus, reliable engagement between said connector and the shell is secured.

Other objects, advantages and novel features of the present invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe the present invention in detail.

Figure 1:
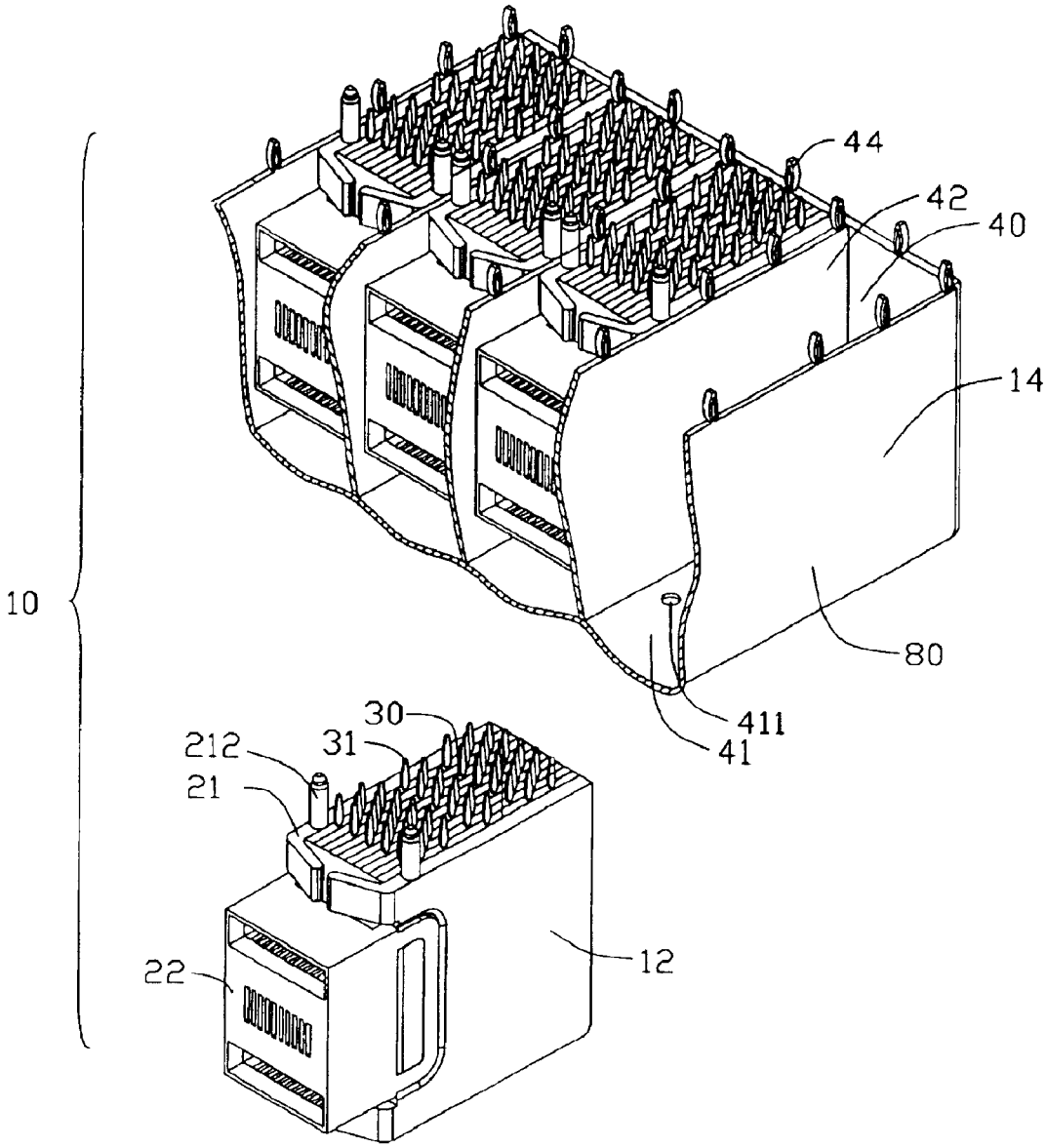
FIG. 1 is an isometric view of an electrical connector assembly in accordance with a preferred embodiment of the present invention.

Referring to FIG. 1, an electrical connector assembly 10 in accordance with a preferred embodiment of the present invention is provided for electrically connecting to a PCB (not shown). The connector assembly 10 comprises a plurality of connectors 12 (in the preferred embodiment, there are, but not limited to, four connectors) and a metal shell 14 surrounding the connectors 12. Each connector 12 comprises an insulative housing 20 and a plurality of terminals 30 mounted to the housing 20. The terminals 30 each have a tail section 31 exposing outside the housing 20, for being soldered onto the PCB.

Figure 2:
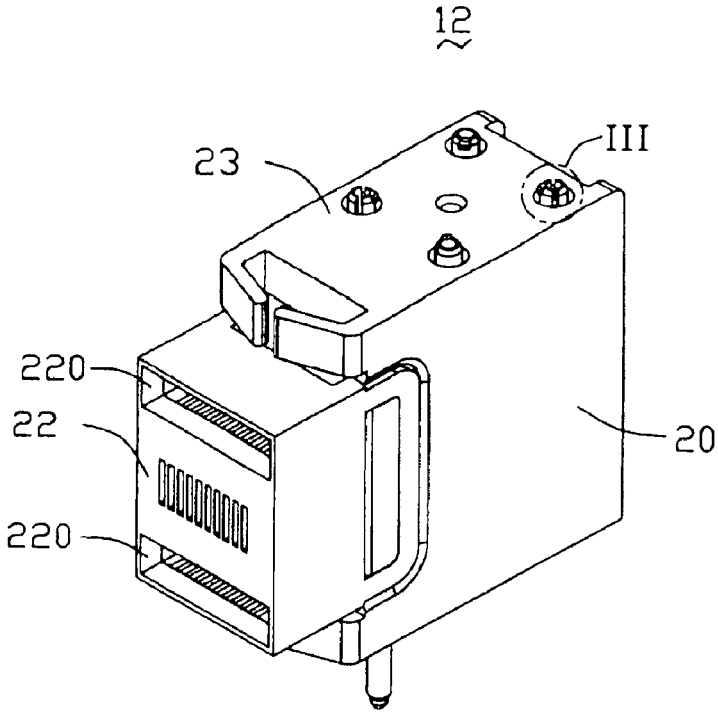
FIG. 2 is an isometric view of a connector of the connector assembly of FIG. 1.
Figure 3:
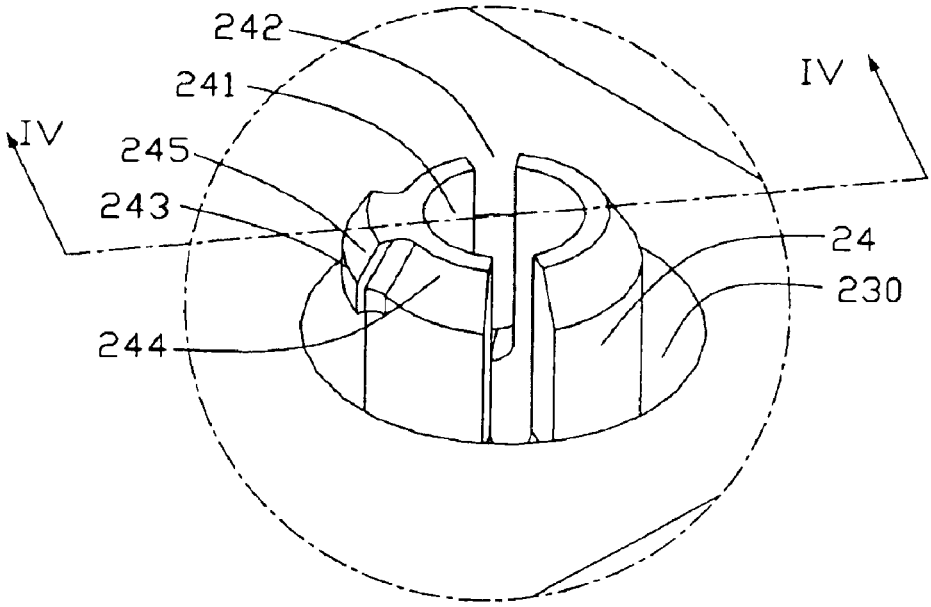
FIG. 3 is an enlarged view of a circled portion III of FIG. 2.
Figure 4:
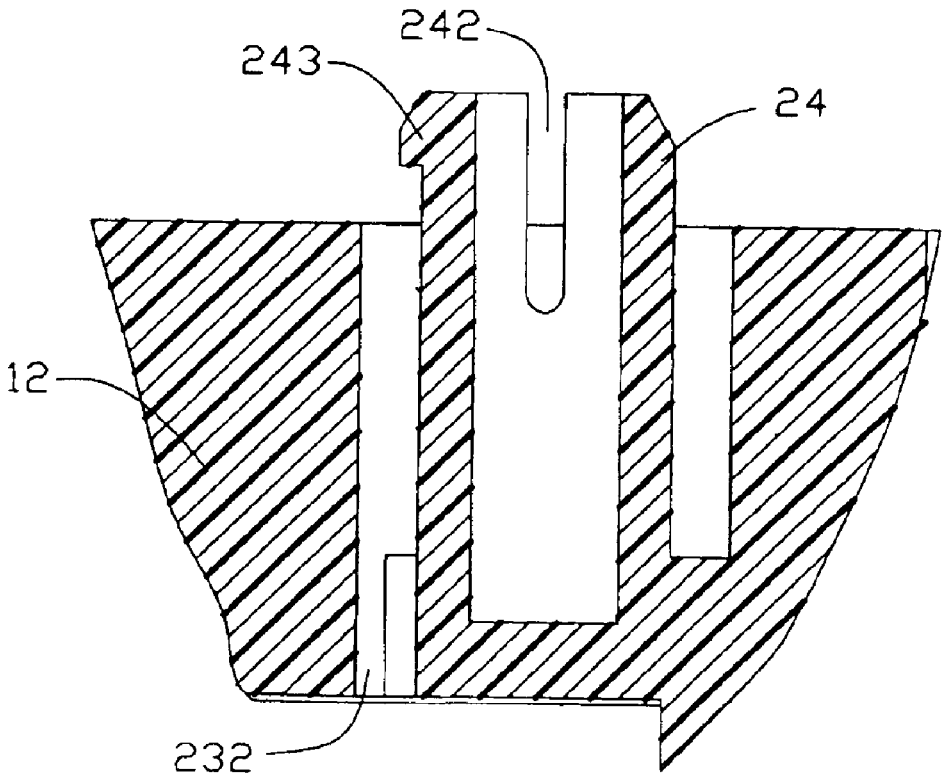
FIG. 4 is a cross-sectional view along a line IV—IV of FIG. 3.

Referring also to FIGS. 2–4, the housing 20 has a horizontal mounting face 21, a lateral mating face 22 adjacent the mounting face 21, and a joint face 23 opposite to the mounting face 21. A plurality of posts 212 is formed outwardly on the mounting face 21, for positioning the connector 12 on the PCB. A pair of grooves 220 is defined in the lateral mating face 22, for receiving a transceiver (not shown). The grooves 220 are parallel to the mounting surface 21. A plurality of circular blind holes 230 extends vertically from the joint face 23, along a direction toward the mounting face 21, to a predetermined length. A locking tab 24 extends axially from a middle of a bottom of each blind hole 230 beyond the joint face 23.

Particularly referring to FIGS. 3 and 4, The locking tab 24 has a cylindrical configuration. A circular center hole 241 is defined in a center of an end of the locking tab 24. A sidewall (not numbered) is formed around the center hole 241, having a uniform thickness. This can provide resilient deformation for the locking tab 24. An aperture 242 is defined at a free end of the locking tab 24. The aperture 242 runs through the locking tab 24 radically, communicating with the center hole 241. The aperture 242 extends downwardly along a vertically axial direction of the locking tab 24, to a determined length, terminating with a half arc end. Two spaced portions are formed at the free end of the locking tab 24, divided by the aperture 242. A block 243 protrudes outwardly from an outside of one of the two spaced portions, a free end thereof flushing with the free end of the locking tab 24. An opening 232 under the block 243 is defined in the joint face 23, for facilitating the molding of the block 243. The opening 232 extends downwardly below the bottom of the blind hole 230, running through the blind hole 230. First and second guiding slopes 244,245 are respectively tapered formed on the free end of the block 24 and the locking tab 243, for facilitating insertion of the locking tab 24 into the shell 14.

Figure 5:
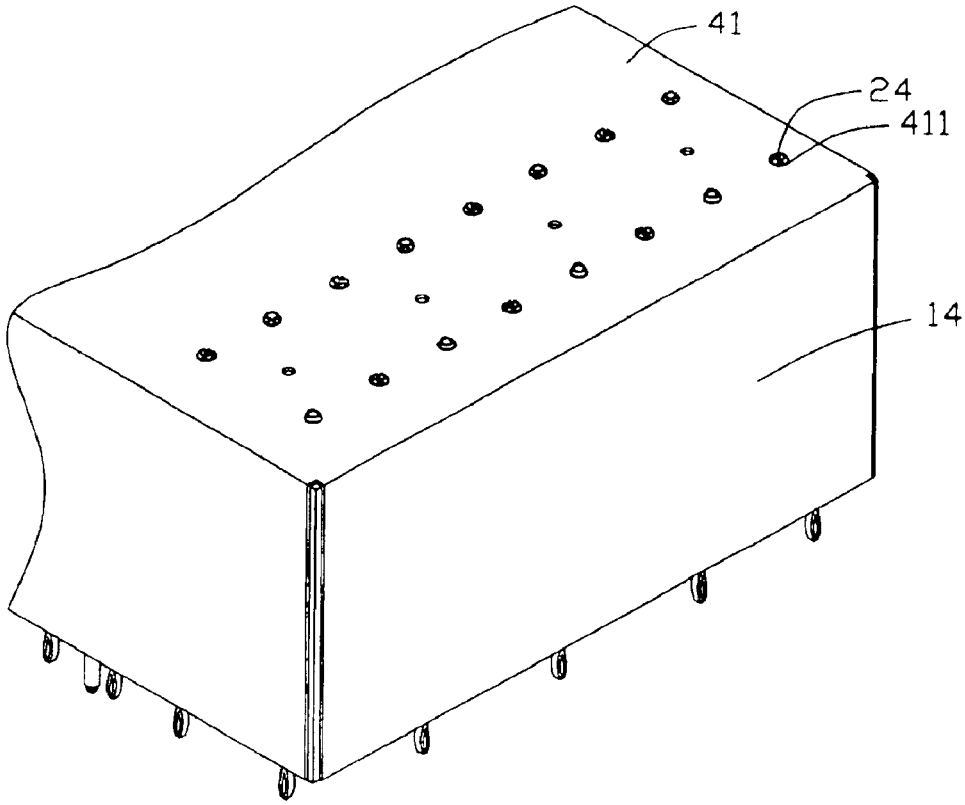
FIG. 5 is an assembled, isometric view of the connector assembly of FIG. 1, but viewed from another aspect.
Figure 6:
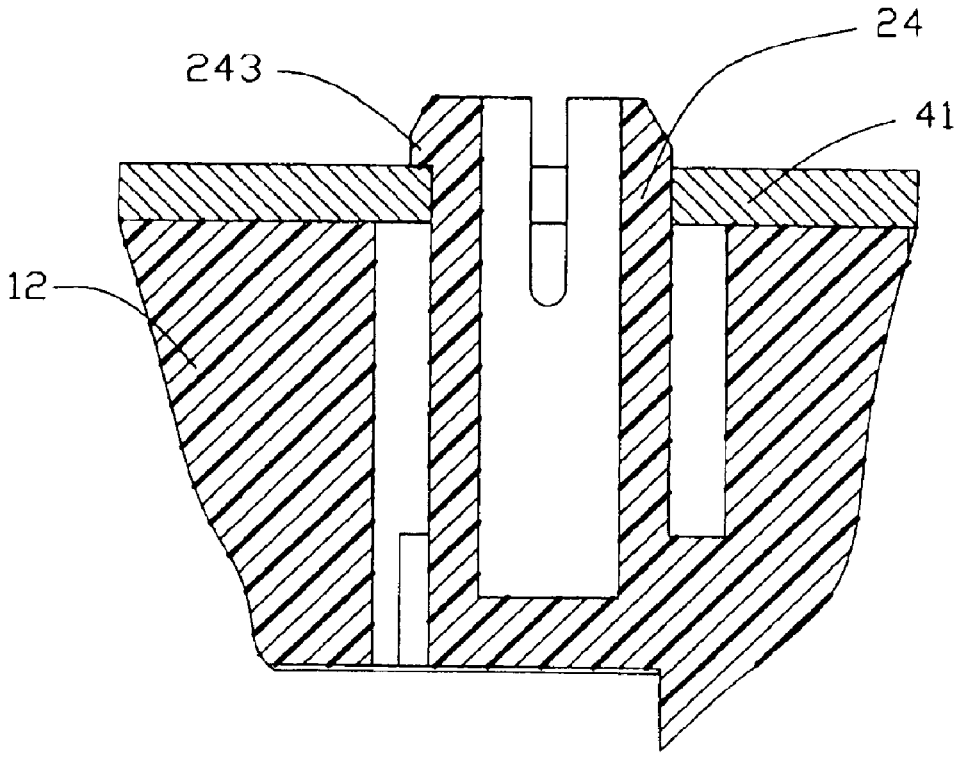
FIG. 6 is similar to FIG. 4, but showing a shell of the connector assembly attached to the connector.
Figure 7:
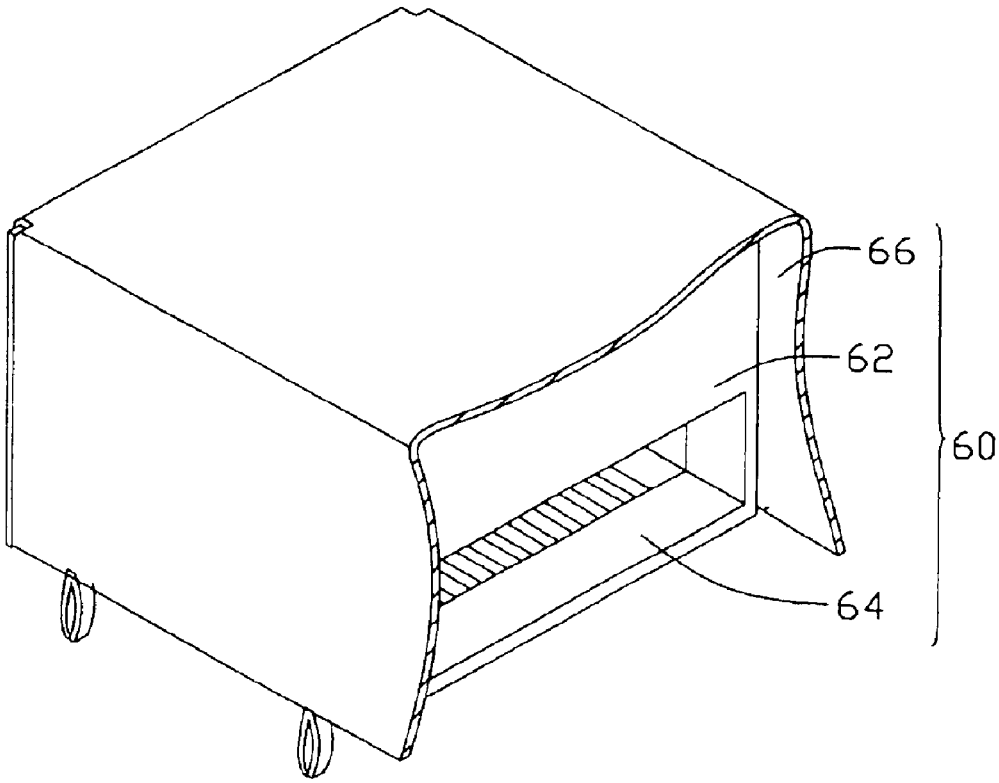
FIG. 7 (PRIOR ART)
FIG. 7 is an assembled, isometric view of a conventional electrical connector assembly.
Figure 8:
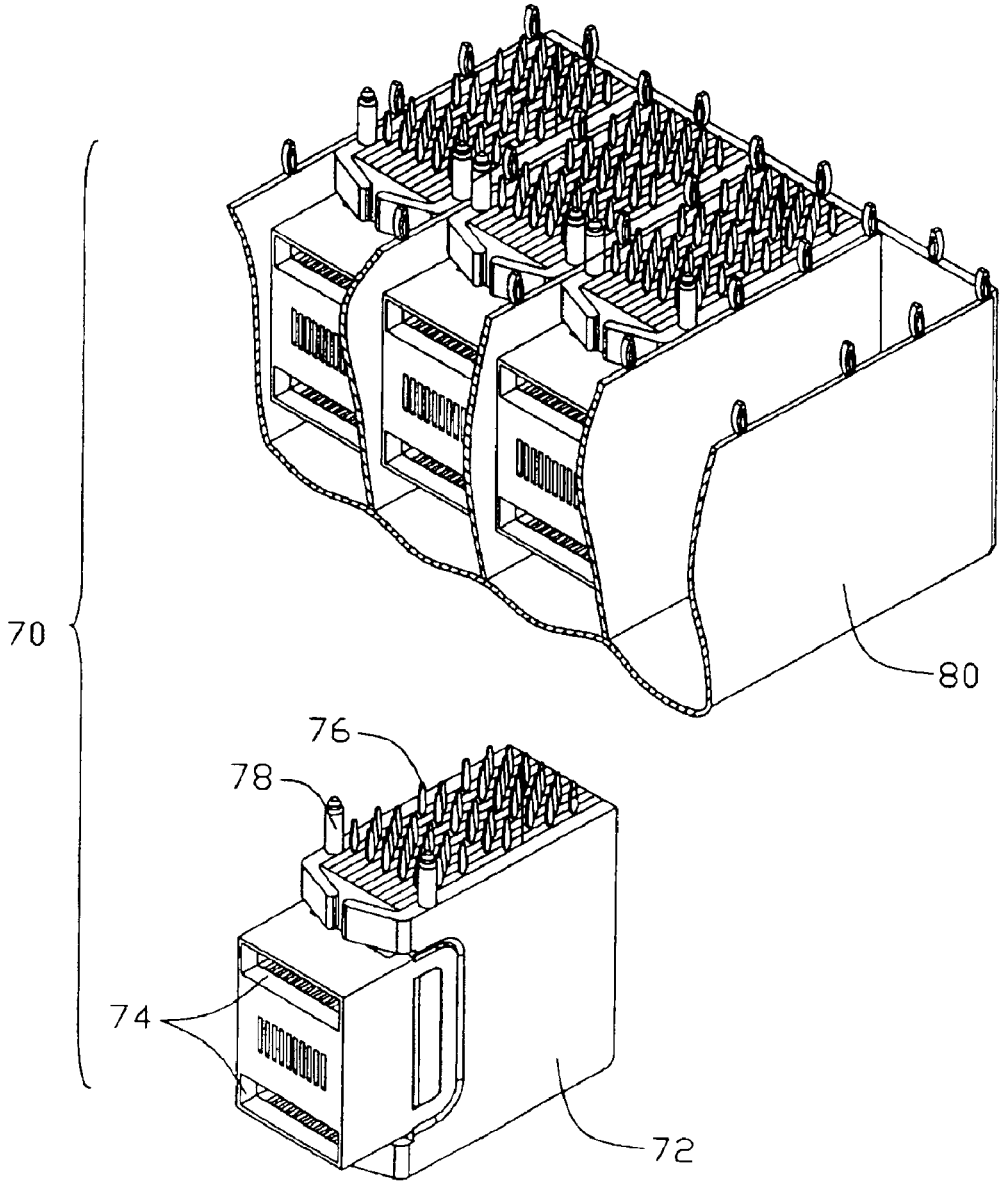
FIG. 8 (PRIOR ART)
FIG. 8 is an assembled, isometric view of another conventional electrical connector assembly.

Referring to FIGS. 1 and 5, the shell 14 has a substantial rectangular configuration. The shell 14 comprises a plurality of cavities 40 and a plurality of parallel spacer 42 between two adjacent cavities 40. The spacers 42 separate the cavities 40 longitudinally apart from each other. The connectors 12 are received into the corresponding cavities 40. A top wall 41 is formed in each cavity 40, for engaging with the joint face 23 of the connector 12. A plurality of circular securing holes 411 is defined in the top wall 41, each securing hole 411 having a diameter approximate to an outside dimension of the locking tab 24. The locking tab 24 is engagingly received in the securing hole 411, for retaining the connector 12 in the cavity 40 of the shell 14. A plurality of positioning legs 44 is formed outwardly on both the spacers 42 and peripheral walls (not numbered) of the shell 14, arranged along the direction of the posts 212 of the connectors 12. The posts 212 of the connectors 12 and the legs 44 of the shell 14 cooperatively hold the connector assembly 10 on the PCB.

Referring to FIGS. 1, 3, 5 and 6, in assembly, the terminals 30 are mounted to the housing 20. The tail section 31 of each terminal 30 exposes beyond the mounting face 21, for electrically connecting with the PCB. The connector 12 is disposed into the cavity 40 of the shell 14. The locking tabs 24 are inserted into the corresponding securing holes 411 of the shell 14 with the guidance of the first and second guiding slopes 244,245 thereof. During the insertion, the locking tabs 24 resiliently deform inwardly to allow the locking tabs 24 to receive in the corresponding securing holes 411 of the shell 14. The block 243 of the locking tab 24 abuts and presses against the top wall 41 of the shell 14, for fastening the locking tab 24 in the securing hole 411. Thus, the connector 12 is retained in the cavity 40 of the shell 14 firmly. Moreover, a vertical distance between the block 243 and the joint face 23 is longer than thickness of the top wall 41 of the shell 14. When the locking tab 24 is inserted in the securing holes 411, the joint wall 411 is pressed on the joint face 23 of the housing 20, to thereby prevent the locking tab 24 from moving axially about the shell 14. As a result, reliable engagement between the connector 12 and the shell 14 is secured.

While the present invention has been described with reference to a preferred embodiment, the description is illustrative and is not to be construed as limiting the invention. Therefore, various equivalent modifications and changes known to persons skilled in the art according to the spirit of the present invention are considered within the scope of the present invention as defined in the appended claims.

What is claimed is:

1. An electrical connector assembly for electrically connecting an electronic interface to a printed circuit board (PCB), the connector assembly comprising:

at least one connector having a joint face opposite to the PCB;

a shield substantially surrounding said connector to provide Electro Magnetic Interference(EMI) shielding and defining a plurality of securing holes; and a plurality of locking tabs extending longitudinally beyond the joint face of said connector for engaging with the corresponding securing holes of the shell shield, each locking tab defining an apertured a block at a free end thereof, the aperture extending downwardly along a vertical axle of the locking tab to a determined length for all wing resilient deformation of the locking tab, the block protruding outwardly from an outside of the locking tab for pressing the shield on the joint face of said connector and holding the locking tab in the securing hole.

2. The electrical connector assembly as claimed in claim 1, wherein an opening under the block is defined in the joint face of said connector to facilitate the molding of the block.

3. The electrical connector assembly as claimed in claim 1, wherein a blind hole is defined at place of the joint face where the locking tab extends through, the blind hole extending downwardly along a direction parallel to the locking tab to a predetermined length.

4. The electrical connector assembly as claimed in claim 1, wherein the locking tab defines a hole thereof, the hole can allow resilient deformation of the locking tab.

5. The electrical connector assembly as claimed in claim 4, wherein first and second guiding slopes are respectively formed on the free end of the locking tab and the block, for facilitating inserting the locking tab into the securing bole of the shield.

6. The electrical connector assembly as claimed in claim 5, wherein said connector has a lateral mounting face adjacent the joint face, and a pair of grooves defined on the mounting face, the grooves parallel to the joint face.

7. An electrical connector assembly comprising:

at least one connector;

an anti-EMI shield substantially surrounding said connector and defining a plurality of securing holes; and a plurality of locking tabs extending vertically beyond a joint face of said connector, for engaging with the corresponding securing holes of the shield each locking tab defines an aperture and block at a free end thereof, the aperture extending vertically to a predetermined length to provide resilient deformation for the locking tab, the block protruding outwardly from an outside of the locking tab for pressing the shield on the joint face of said connector, the locking tab being retained resiliently in the securing hole, to thereby firmly assemble said connector into the shield.

8. The electrical connector assembly as claimed in claim 7, wherein a plurality of blind holes is defined in said connector, each blind hole corresponding and being larger than the locking tab, the locking tab extending from bottom of the blind hole therethrough.

9. The electrical connector assembly as claimed in claim 8, wherein said connector defines an opening therein under the block, the opening communicating with the blind hole to facilitate the molding of the block.

10. The electrical connector assembly as claimed in claim 9, wherein the locking tab defines a center axial hole at an end thereof and an radial aperture communicating with the center hole, the hole and the aperture can allow resilient deformation of the locking tab.

11. The electrical connector assembly as claimed in claim 10, wherein the locking tab has a guiding face on the free end thereof for facilitating inserting the locking tab into the securing hole of the shield.

12. The electrical connector assembly as claimed in claim 11, wherein said connector has a lateral mounting face adjacent the joint face, and a pair of grooves defined in the mounting face for receiving a transceiver therein, respectively.

13. The electrical connector assembly as claimed in claim 12, wherein a plurality of positioning members is respectively formed on the mounting face of said connector and the shield for fixing the connector assembly on a PCB.

14. The electrical connector assembly as claimed in claim 13, wherein the shield has a substantial rectangular configuration and at least one receiving cavity for accommodating said connector therein, respectively.

15. The electrical connector assembly as claimed in claim 14, wherein said cavity has a wall matting with the joint face of said connector, the securing holes being defined in and extending through the wall.

16. An electrical connector assembly comprising:

a PCB;

a connector mounted on the PCB, the connector comprising at least one sub-connector having a joint face opposite the PCB, a shield substantially surrounding said sub-connector to provide EMI shielding for said sub-connector, the shield defining a plurality of securing holes to engagingly position said sub-connector therein; and a plurality of locking members formed on said sub-connector, the locking members corresponding and engaging with the securing holes of the shield for firmly assembling said sub-connector and the shield together, the locking members extending vertically from a lower place and beyond the joint face, each locking member defines an aperture and a block at a free end thereof, the aperture running radially through the locking member and extending axially to a determined length to allow resilient deformation of the locking member, the block protruding outwardly from an outside of the locking member to press the shield on the joint face.

17. The electrical connector assembly as claimed in claim 16, wherein said sub-connector defines a plurality of circular blind holes, the locking member being formed on bottom of a corresponding blind hole and extending axially therethrough.

18. The electrical connector assembly as claimed in claim 17, wherein said sub-connector defines an opening therein communicating with the blind hole to facilitate the molding of the block.

19. The electrical connector as assembly claimed in claim 18, wherein the locking member defines a center axial hole at an end thereof and an radial aperture communicating with the center hole, the hole and the aperture can allow resilient deformation of the locking member.

20. The electrical connector as assembly claimed in claim 19, wherein a plurality of positioning members is respectively formed on said sub-connector and the shield for fixing the connector on the PCB.

* * * * *